US005718370A

United States Patent [19]

Lafferty et al.

[11] Patent Number: 5,718,370

[45] Date of Patent: Feb. 17, 1998

[54] PARTIALLY SHIELDED MICROWAVE HEATING CONTAINER

[75] Inventors: Terrence P. Lafferty, Milford; James L. Capo, Middletown, both of Ohio

[73] Assignee: Fort James Corporation, Richmond, Va.

[21] Appl. No.: 652,166

[22] Filed: May 23, 1996

[51] Int. Cl.[6] ..... B65D 5/488; B65D 5/56

[52] U.S. Cl. ..... 229/120.18; 219/729; 229/114; 229/903; 229/906; 493/110

[58] Field of Search ..... 219/729; 426/107; 229/114, 120.18, 120.17, 902, 903, 906; 493/96, 97, 110, 148, 907

[56] References Cited

U.S. PATENT DOCUMENTS

| | | | |
|---|---|---|---|
| 4,015,085 | 3/1977 | Woods . | |
| 4,081,125 | 3/1978 | Meyers | 229/120.18 |
| 4,081,646 | 3/1978 | Goltsos . | |
| 4,133,896 | 1/1979 | Standing et al. . | |
| 4,190,757 | 2/1980 | Turpin et al. . | |
| 4,233,325 | 11/1980 | Slangan et al. . | |
| 4,431,128 | 2/1984 | Dirico | 229/120.17 |
| 4,656,325 | 4/1987 | Keefer | 219/729 |
| 4,676,857 | 6/1987 | Scharr et al. | 426/107 |
| 4,794,008 | 12/1988 | Schmidt et al. . | |
| 4,851,631 | 7/1989 | Wendt . | |
| 4,866,232 | 9/1989 | Stone | 219/729 |
| 4,894,503 | 1/1990 | Wendt . | |
| 4,926,020 | 5/1990 | Atwell et al. . | |
| 5,270,066 | 12/1993 | Pawlowski | 219/729 |
| 5,416,304 | 5/1995 | De La Cruz et al. | 219/729 |
| 5,416,305 | 5/1995 | Tambellini | 229/903 |

*Primary Examiner*—Gary E. Elkins

*Attorney, Agent, or Firm*—Sixbey, Friedman, Leedom & Ferguson, P.C.; Charles M. Leedom, Jr.; Donald R. Studebaker

[57] ABSTRACT

A paperboard container for heating products placed therein by microwave energy having a first compartment substantially shielded from microwave energy and a second compartment permeable by microwave energy. The first and second compartments each include a top panel and a bottom surface, where a single bottom panel serves as the bottom surface for both of the first and second compartments. The container further includes a plurality of side panels extending upwardly from the bottom panel and a plurality of side panels extending downwardly from the top panels. Both of the first and second compartments are formed from a unitary, single sheet of microwave permeable paperboard material, wherein the first compartment includes a layer of microwave shielding material laminated to the portion of the sheet of microwave permeable paperboard material which forms a majority of the enclosing surfaces of the first microwave shielded compartment.

20 Claims, 4 Drawing Sheets

PARTIALLY SHIELDED MICROWAVE HEATING CONTAINER

BACKGROUND OF THE INVENTION

1. Technical Field

The present invention relates to a sectioned carton having a compartment which is shielded from microwave energy and another compartment which is exposed to microwave energy. More particularly, the invention pertains to a carton formed from a single blank of microwave permeable sheet material which is cut, scored and folded to form a multi-compartment container, wherein at least one section is coated with a material substantially impermeable by microwaves.

2. Background Art

Multi-compartment containers have been manufactured with a variety of constructions which allow portions of the container to be exposed to microwave energy while shielding other portions from the microwave energy. Many of these constructions, however, pertain to pre-packaged food products and do not allow the end user of the container to selectively place the food products into either shielded or non-shielded compartments in the container. Additionally, these constructions are often formed from separate components or materials for each compartment and must be assembled together to form the multi-compartment container.

U.S. Pat. No. 4,233,325 issued to Slangan et al. discloses one such microwaveable multi-compartment package. This package includes a lower compartment, containing frozen ice cream, which is substantially impermeable to microwave energy and an upper compartment, containing frozen syrup, which is microwave permeable. The package is placed in a microwave oven to melt the frozen syrup in the upper compartment. The two compartments are manufactured from separate cardboard blanks, formed and then fit together, wherein the upper compartment further includes a lip for easy removal of the upper compartment from the food package after microwave heating.

A similar multi-compartment packaged food product is disclosed in U.S. Pat. No. 4,794,008 issued to Schmidt et al. As in the above-mentioned patent, an upper frozen food compartment permeable to microwave energy is provided with a lower frozen food compartment which is reflective of microwaves. The compartments are formed into U-shaped plastic compartments and joined together to form a single multi-compartment food package, and the two compartments must be further separated from one another after heating in order to access the food contained within the compartments. Both of the above-mentioned patents further are directed to pre-packaged frozen products, such as ice cream in the lower compartment and syrup in the upper compartment, wherein the upper and lower compartments are arranged vertically.

U.S. Pat. No. 4,081,646 issued to Goltsos discloses a multi-compartment heating container including a tray and cover which are thermoformed from plastic which is transparent to microwave energy. Furthermore, the outer surfaces of the tray and cover may be shielded against the microwave energy by a thin film of radiation-opaque material, except for the regions which are intended to define microwave-transparent openings. Each compartment in this container is shielded against different amounts of microwave energy by leaving different sized windows on each compartment free from radiation-opaque material, wherein these windows are substantially identical to windows formed in the cover so that the windows in the cover will be in alignment with the windows on the tray. Forming the radiation-opaque material on the majority of the already formed curved surfaces of the thermoformed container and then removing portions of the radiation-opaque material to form windows adds significantly to the costs and complicates the manufacturing process entailed in forming the final product. Additionally, the formation of substantially identical windows in the radiation-opaque material must be performed with precision and requires additional steps after the container is thermoformed.

Therefore, as can be seen from the foregoing, there is clearly a need for a carton of the above-mentioned type which includes a microwave permeable compartment and a microwave shielded compartment, which is formed from a single microwave permeable blank having a portion of the blank laminated with a microwave shielding layer. There is further a need for a partially shielded microwave heating container which can be filled with a product by the end user of the package and does not need to be pre-packaged with a food product.

SUMMARY OF THE INVENTION

It is a primary object of the present invention to overcome the aforementioned shortcomings associated with the prior art.

Another object of the present invention is to provide a paperboard carton having a compartment which is permeable by microwave energy and another compartment which is reflective to microwave energy.

Yet another object of the present invention is to provide a multi-compartment microwave heating carton having a compartment shielded against microwaves and a microwave permeable compartment wherein both compartments are formed from a single paperboard blank.

It is yet another object of the present invention is to provide a microwave heating carton partially shielded against microwaves which is formed from a single paperboard blank laminated with a microwave reflective material on only a portion of the paperboard blank.

Still another object of the present invention is to provide a multi-compartment microwave heating carton having a compartment shielded against microwaves and a microwave permeable compartment which does not need to be pre-packaged with a product and which allows the end user to place the products being used into the two compartments.

These as well as additional objects and advantages of the present invention are achieved by producing a paperboard container for heating products placed therein by microwave energy having a first compartment substantially shielded from microwave energy and a second compartment permeable by microwave energy. The first and second compartments each include a top panel and a bottom surface, where a single bottom panel serves as the bottom surface for both of the first and second compartments. The container further includes a plurality of side panels extending upwardly from the bottom panel and a plurality of side panels extending downwardly from the top panels. Both of the first and second compartments are formed from a unitary, single sheet of microwave permeable paperboard material, wherein the first compartment includes a layer of microwave shielding material laminated to the portion of the sheet of microwave permeable paperboard material which forms a majority of the enclosing surfaces of the first microwave shielded compartment.

DETAILED DESCRIPTION OF THE PREFERRED EMBODIMENT

Figure 1:
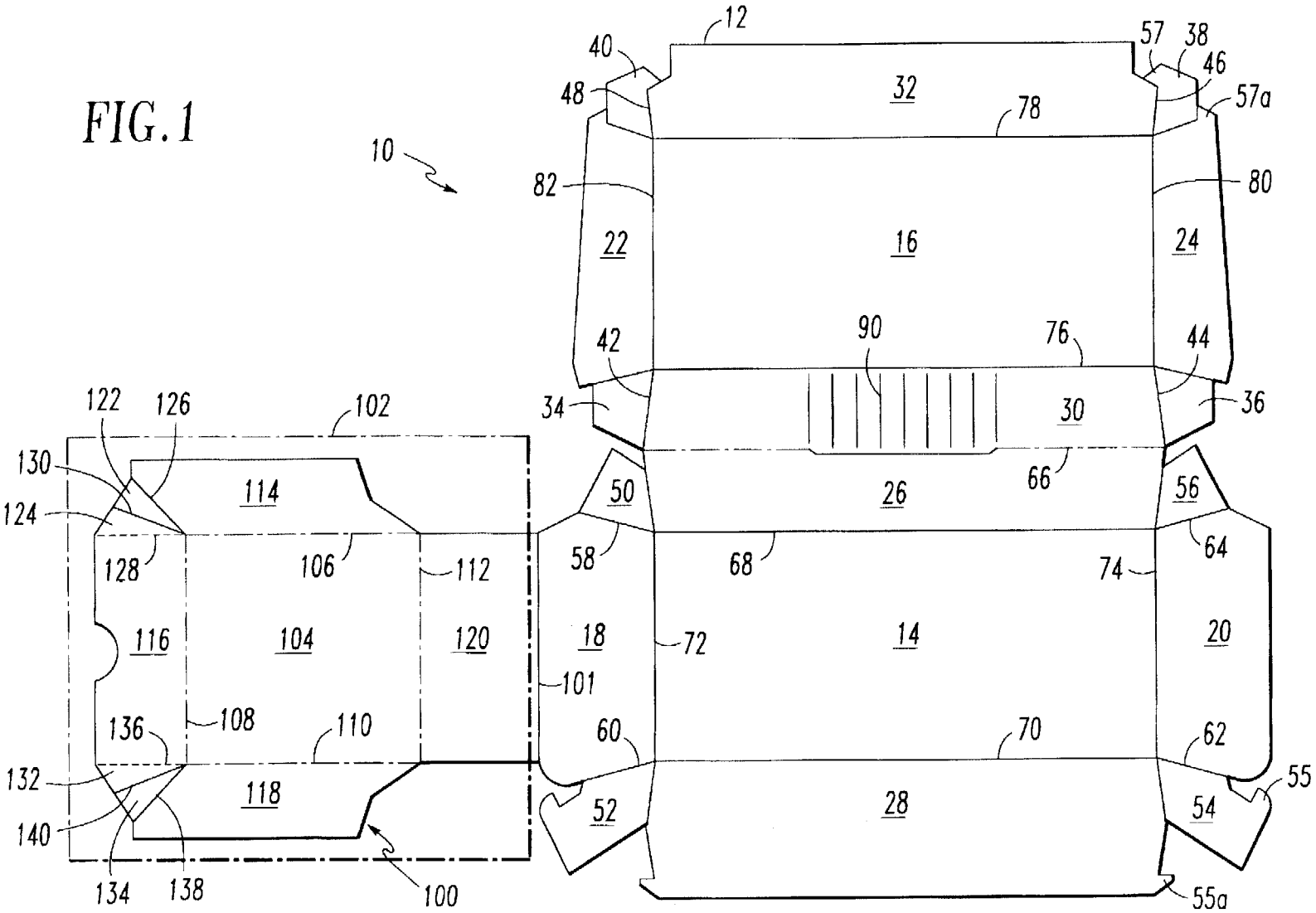
FIG. 1 is a top view of the paperboard blank used in forming the shielded microwave heating device in one embodiment of the present invention.

Referring now to FIG. 1, the microwave heating carton 10 of the present invention is formed from a single blank 12 of paperboard or similar microwave permeable sheet material, and the microwave heating container 10 is preferably formed in a clamshell-like shape. The blank 12 includes a top panel 14 and bottom panel 16 with the top panel flanked by end walls 18 and 20 and the bottom panel flanked by end walls 22 and 24. The top and bottom panels 14 and 16 are also flanked by side walls 26 and 28, and 30 and 32, respectively. The side walls 30 and 32 of the bottom panel 16 include extensions 34, 36, 38 and 40 attached thereto and joined to the side walls 30 and 32 by fold lines 42, 44, 46 and 48, respectively. Extensions 50, 52, 54 and 56 are attached to the end walls 18 and 20 of top panel 14 through fold lines 58, 60, 62 and 64.

The carton blank 12 additionally has main body crease score lines 66 between side wall 26 and side wall 30 which form a pivotal axis between the top panel 14 and bottom panel 16 of the clamshell microwave heating container 10. The carton blank 12 further includes fold lines 68, 70, 72 and 74 between the top panel 14 and side walls 26 and 28 and end walls 18 and 20, and fold lines 76, 78, 80 and 82 between the bottom panel 16 and side walls 30 and 32 and end walls 22 and 24, respectively.

The carton blank 12 further includes a shielding clamshell section 100 connected to the end wall 18 of the top panel 14 through fold line 101. A layer 102 of aluminum foil or similar material substantially impermeable by microwave energy (shown in broken lines) is bonded to one surface of the shielding clamshell section 100 to provide a microwave shield. As shown and described hereinafter, the foil layer 102 is bonded to the outer surface of the clamshell section 100. However, the foil layer 102 may alternatively be bonded to the inner surface of the clamshell section 100.

The clamshell section 100 includes a top panel 104 joined by fold lines 106, 108, 110 and 112 to sidewalls 114, 116, 118 and 120, respectively. The clamshell section 100 has no bottom wall, for the bottom wall for the clamshell section 100 is provided by the bottom panel 14 of the microwave heating carton 10. The clamshell section 100 includes diagonal corner panels 122 and 124 joined to sidewalls 114 and 116 by crease score lines 126 and 128, wherein crease score lines 130 are also formed between corner panels 122 and 124. The clamshell section 100 further includes diagonal corner panels 132 and 134 joined to sidewalls 116 and 118 by crease score lines 136 and 138, wherein crease score lines 140 are also formed between corner panels 132 and 134.

Figure 2:
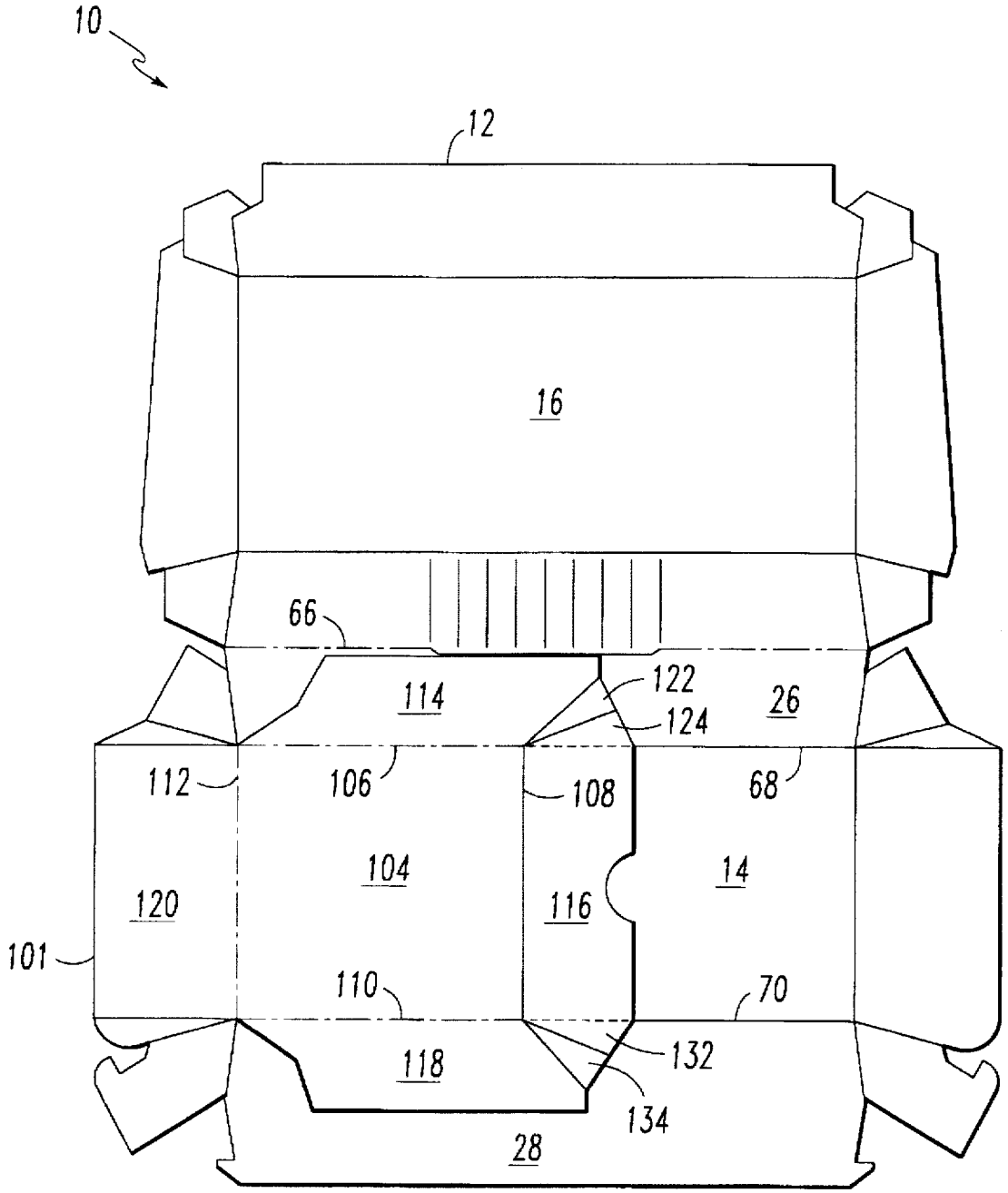
FIG. 2 is a top view of the paperboard blank of FIG. 1 in a partially assembled state.

Referring now to FIG. 2, the clamshell microwave heating container 10 is shown partially assembled and will be hereinafter described showing the construction of the package 10 having a microwave shielded section and a microwave heatable section. The clamshell section 100 is folded about fold line 101 so that the clamshell section 100 is positioned within the upper portion of the microwave heating container 10. The top panel 104 of clamshell section 100 is positioned adjacent to and substantially parallel to the top panel 14 of microwave heating container 10 with the foil layer 102 side of clamshell section 100 facing top panel 14. The width of top panel 104 is substantially the same as top panel 14 so that the fold lines 106, 110 and 112 of clamshell section 100 correspond to and overlie the fold lines 68, 70 and 72 attached to top panel 14. From the view shown in FIG. 2, the side walls 26 and 28 and end wall 18 underlie sidewalls 114, 118 and 120, respectively. After section 100 is folded about fold line 101 and before further assembly, top panel 14 underlies sidewall 116 of shielded clamshell section 100, side wall 26 underlies diagonal corner panels 122 and 124, and side wall 28 underlies diagonal corner panels 132 and 134.

At this point in the assembly of the microwave heating container 10, all of the panels, side walls, and end walls are in substantially the same plane. The side walls of the microwave heating container 10 are now folded along their respective fold lines toward the side walls on the opposite side of the top and bottom panels 14 and 16. Therefore, side walls 26 and 28 are folded toward each other along fold lines 68 and 70 so that angles are now formed between side walls 26 and 28 and the top panel 14. End walls 18 and 20 are also folded toward each other along/bid lines 72 and 74 so that angles are now formed between end walls 18 and 20 and the top panel 14, wherein extensions 50, 52, 54 and 56 are folded along fold lines 58, 60, 62 and 64 so that extensions 52 and 54 are adjacent to and substantially parallel to side wall 28 and extensions 50 and 56 are adjacent to and substantially parallel to side wall 26. The top portion of the clamshell shape of the microwave heating container 10 is formed in this manner. The bottom portion of the clamshell shape is similarly formed. Side walls 30 and 32 are folded toward each other along fold lines 76 and 78 so that angles are now formed between side walls 30 and 32 and the bottom panel 16. End walls 22 and 24 are also folded toward each other along fold lines 80 and 82 so that angles are now formed between end walls 22 and 24 and the bottom panel 16, wherein extensions 34, 36, 38 and 40 are folded along fold lines 42, 44, 46 and 48 so that extensions 34 and 40 are adjacent to and substantially parallel to end wall 22 and extensions 36 and 38 are adjacent to and substantially parallel to end wall 24.

Additionally, the microwave heating container 10 is folded along crease score line 66 so that an angle is formed between side walls 26 and 30 such that top panel 14 and bottom panel 16 remain substantially in the same plane. In the preferred embodiment, crease score line 66 includes three parallel score lines with the two outside score lines providing a folding point for side walls 26 and 30 and the middle score line providing a pivotal folding axis between side walls 26 and 30.

With all of the end walls and side walls folded up in an assembled state, the microwave heating container resembles an open clamshell with top panel 14 and bottom panel 16 facing upward and positioned in substantially the same plane. This open position allows a plurality of semi-assembled microwave heating containers 10 to be stacked on top of each other and stored in this open position.

The assembly of the microwave heating container 10 is completed by forming the separate microwave shielded and microwaveable sections. This is accomplished by folding the side wall 116 of clamshell section 100 along fold line toward the already folded end wall 120 and underlying end wall 18. As side wall 116 is folded upward, diagonal corner panels 122 and 124 are folded along fold line 130 so that the outer surfaces of corner panels 122 and 124 having the foil layer thereon face one another. Similarly, diagonal corner panels 132 and 134 are folded along fold line 140 so that the outer surfaces of corner panels 132 and 134 having the foil layer thereon face one another. The upwardly folded side wall 116 divides the top portion of the clamshell microwave heating container 10 into two sections. The side wall 26 is folded along crease score line 66 with respect to side wall 30 so that the upper portion of the clamshell microwave heating container 10 closes over the lower portion of the clamshell microwave heating container 10. The inner surface of top panel 14 faces downward toward the inner surface of bottom panel 16 when the clamshell microwave heating container 10 is in a closed position.

This configuration allows a microwave shielded section as well as a microwave accessible section to be formed within the microwave heating container 10. Since the clamshell section 100 is coated with a microwave shielding foil layer 102, the portion of package 10 enclosed by clamshell section 100 forms the microwave shielded section. The microwave shielded section is enclosed by top panel 104, side walls 114, 116, 118, 120, 26, 28, 30 and 32, and bottom panel 16. The bottom portion of the microwave shielded section surrounded by bottom panel 16 and side walls 30 and 32 is permeable to microwave energy, because bottom panel 16 and side walls 30 and 32 are comprised of the microwave permeable paperboard described above and are not covered by a foil layer. However, the microwave energy will be applied from above the microwave heating container 10 and directed toward the top panel 14, wherein the bottom panel 16 of microwave heating container 10 will rest upon the bottom surface of the microwave heating apparatus so only a small fraction of microwaves emitted will actually pass through the bottom portion of the microwave shielded section of heating container 10. Therefore, a product may be placed within the microwave shielded section where the bottom portion of the product is intended to be heated while the top portion of the product is not intended to be heated, since the small amount of microwaves entering the bottom portion of the microwave shielded section will only heat that portion of a product adjacent to the bottom portion of the microwave shielded section. The non-shielded microwave section of the package 10 is enclosed by top panel 14, bottom panel 16, side walls 26, 28, 30, 32 and 116, and end wall 20. The non-shielded microwave section is divided from the microwave shielded section by a common dividing wall, side wall 116, wherein side wall 116 is the section of the non-shielded microwave section which is opaque to microwave radiation.

The microwave heating container 10 may also employ a locking attachment which retains the heating container 10 in a closed state after top panel 14 is closed over bottom panel 16. The locking attachment is obtained by connecting hook-like projections 55 extending from extensions 52 and 54 with similar projections 57 extending from extensions 38 and 40. Similarly shaped projections **55*a* are formed on side wall 28 so that each projection 55 is aligned with projection 55*a* when extensions 52 and 54 are folded to lie adjacent to side wall 28. Likewise, projections 57*a* are formed on end walls 22 and 24 so that each projection 57 is aligned with projection 57*a* when extensions 38 and 40 are folded to lie adjacent to end walls 22 and 24. This arrangement provides the projections 55 and 57 with a double-walled construction which gives the projections 55 and 57 added strength and support. The side wall 30 may also include ridges 90 formed therein to provide greater support along the direction of the ridges 90**.

The clamshell section 100, top panel 14, bottom panel 16 and all side walls are all formed from the same paperboard carton blank 12. Therefore, the above-described configuration provides a simple and efficient method of manufacturing a multi-compartment heating container 10 which allows one compartment to be heated by microwave energy while another compartment is substantially shielded from the microwave energy. The heating container is easily formed by laminating a portion of a paperboard blank 12, cutting the blank 12 into the desired shape, and forming the desired fold lines in the blank 12 so that it may be assembled into a multi-sectioned microwave heating container 10. This configuration allows multiple products to be placed into the heating container 10 and exposing the heating container 10 to microwave energy, while only the products in the non-shielded portion of the heating container 10 are actually heated by the microwave energy.

Figure 3:
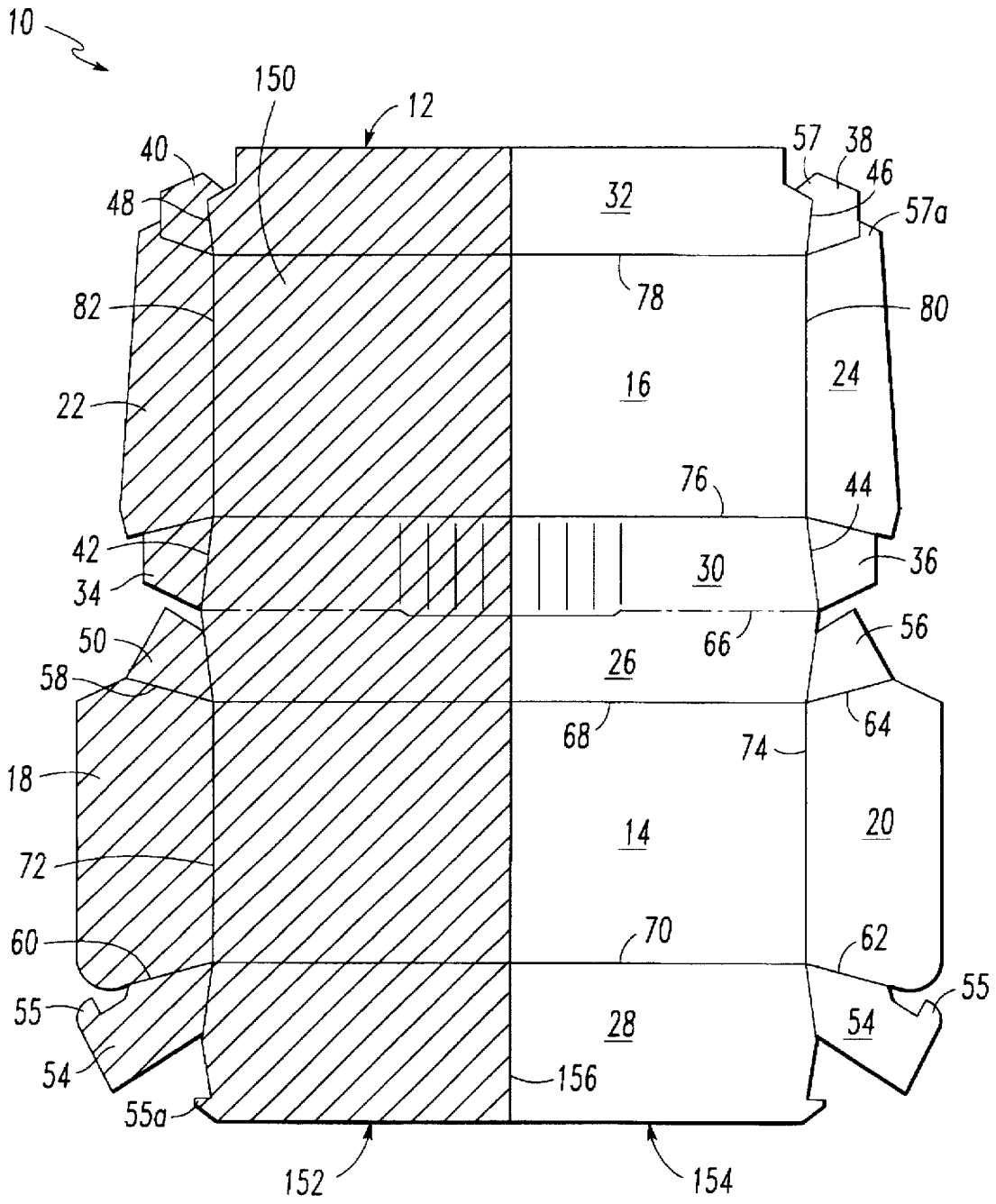
FIG. 3 is a top view of the paperboard blank used in forming the shielded microwave heating device in an alternative embodiment of the present invention.

An alternative embodiment to the clamshell-shaped microwave heating container 10 is illustrated in FIG. 3, wherein the clamshell section 100 is eliminated from the embodiment described above in connection with FIGS. 1 and 2. This embodiment provides an even simpler construction for a clamshell-shaped microwave heating container 10 having a microwave permeable section and a microwave shielded section. Unless specifically described otherwise, all of the components of this embodiment are substantially equivalent to the similarly numbered components of FIGS. 1 and 2 and their descriptions need not be repeated.

One-half of the paperboard blank 12 is laminated with a microwave reflective layer 150, such as aluminum foil or the like, and then cut and scored to form the microwave heating container 10 shown in FIG. 3 having a microwave shielded section 152 and a microwave permeable section 154. The foil layer 150 covers one-half of the length of the inside surfaces of the top panel 14, bottom panel 16, and side walls 26, 28, 30 and 32, while completely covering the inside surfaces of end walls 18 and 22 and extensions 34, 40, 50 and 52. The microwave heating container 10 is assembled exactly as described above, except that all of the sections of clamshell section 100 from FIGS. 1 and 2 have been removed from this embodiment.

Once the top portion of the microwave heating container 10 has been folded to close the package, the inside surfaces of the top panel 14 and bottom panel oppose one another. The microwave shielded section 152 is enclosed by top panel 14, side walls 26, 28, 30 and 32, end walls 18 and 22, and bottom panel 16. Additionally, extensions 34, 40, 50 and 52 will also serve to enclose the microwave shielded section 152 since they are affixed to the inner laminated surfaces of end wall 18 and side walls 30 and 32, respectively. The microwave permeable section 154 is enclosed by top panel 14, side walls 26, 28, 30 and 32, end walls 20 and 24, bottom panel 16, and extensions 36, 38, 54 and 56.

The microwave shielded section 152 will only be enclosed on five sides with the sixth side 156, the side lying in the plane between microwave shielded section 152 and microwave permeable section 154, being open to the microwave permeable section 154. With this embodiment, it is possible for microwaves to enter the microwave shielded section 152 through this open side 156 between the two sections 152 and 154. However, the microwave energy will be applied from above the microwave heating container 10 and directed toward the outer surface of top panel 14, wherein the bottom panel 16 of microwave heating container 10 will rest upon the bottom surface of the microwave heating apparatus and only a small fraction of microwaves emitted will actually pass through the open side 156 of microwave shielded section 152. In order for any microwaves to enter through open side 156, the microwaves must first pass through microwave permeable section 154 where the microwaves will encounter the product placed therein to be heated. Therefore, very few microwaves will actually enter into the microwave shielded section 152 through open side 156.

The microwave heating container 10 may thus be sent to the end user in a partially assembled state where both the top panel 14 and bottom panel 16 facing upwards, where the end user need only place the desired products within the microwave shielded section 152 and microwave permeable section 154 and close the top panel 14 over the bottom panel 16. A plurality of microwave heating containers 10 may be stacked together in this partially assembled state and shipped to the end user in this manner.

Figure 4:
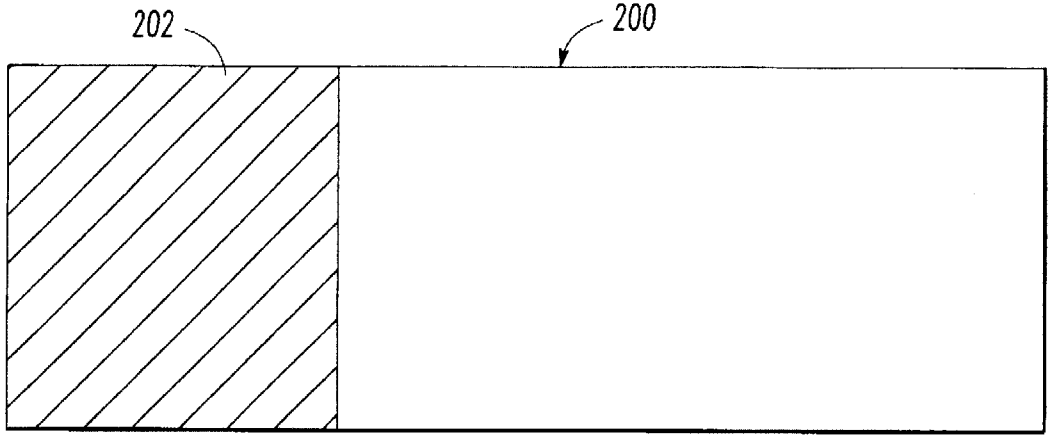
FIG. 4 is a top view of the sheet of paperboard material having a laminated portion before it is formed into a paperboard blank in yet another alternative embodiment.
Figure 5:
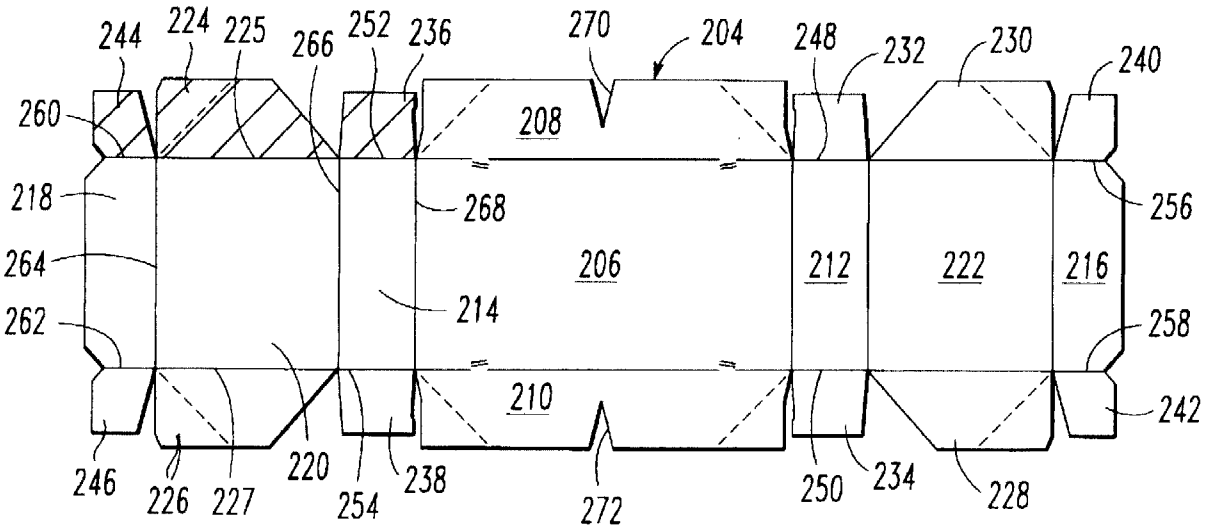
FIG. 5 is a top view of the paperboard blank formed from the sheet of paperboard material shown in FIG. 4.

While the above-described clamshell shape is the preferred embodiment of the present invention, the microwave heating container 10 may alternatively be formed as illustrated in FIGS. 4 and 5. FIG. 4 illustrates a single blank 200 comprised of a microwave permeable material, such as paperboard, which includes a layer of microwave shielding material 202, such as aluminum foil, bonded to area on one end of the blank 200. The blank 200 is cut and scored as shown in FIG. 5 so that the blank 200 may be folded to form a microwave heating container 204 having two compartments, one compartment shielded from microwave energy and another compartment permeable by microwave energy.

The microwave heating container 204 includes a bottom panel 206, side walls 208 and 210, end walls 212, 214, 216 and 218, and top panels 220 and 222. End walls 214 and 218 and top panel 220 are formed from the area with aluminum foil 202 bonded to the blank 200. The top panel 220 is flanked by end walls 214 and 218 and further flanked by side walls 224 and 226, while top panel 222 is flanked by end walls 212 and 216 and side walls 228 and 230. The end walls 212, 214, 216 and 218 include extensions 232, 234, 236, 238, 240, 242, 244 and 246 attached thereto through fold lines 248, 250, 252, 254, 256, 258, 260 and 262, respectively.

The shielded compartment of microwave heating container 204 is assembled by folding side walls 208 and 210 toward one another until each side wall forms approximately a 90° angle with bottom panel 206. Extensions 236 and 238 are folded toward one another until each extension forms approximately a 90° angle with end wall 214. Similarly, side walls 224 and 226 are folded toward one another along fold lines 225 and 227 until the side walls 224 and 226 form approximately a 90° angle with top panel 220, and extensions 244 and 246 are folded toward one another until the extensions 244 and 246 form approximately a 90° angle with end wall 218. End wall 218 is folded along fold line 264 until end wall 218 forms approximately a 90° angle with respect to top panel 220 with extensions 244 and 246 adjacent to side walls 224 and 226. Top panel 220 is folded along fold line 266 so that the top panel 220 forms approximately a 90° angle with respect to end wall 214 where side walls 224 and 226 are also adjacent to extensions 236 and 238. End wall 214 is folded along fold line 268 so that the end wall 214 forms approximately a 90° angle with respect to bottom panel 206 and top panel 220 is substantially parallel to bottom panel 206.

Side walls 208 and 210 have notches 270 and 272 formed therein which are positioned to receive end wall 218 as the microwave shielded compartment is assembled. After the above-described folds to the blank 200 have been made, the microwave shielded compartment of the microwave heating container 204 is enclosed by top panel 220, end walls 214 and 218, side walls 224 and 226, and bottom panel 206. The microwave shielded compartment of this alternative embodiment will thus be rectangular in shape with the bottom panel 206 not including a microwave shielding layer 202. However, since bottom panel 206 will rest against the bottom surface of the microwave heating device, no microwave energy will pass through the bottom panel 206 into the microwave shielded compartment. Thus, this embodiment of the present invention prevents substantially all microwave radiation from entering the microwave shielded compartment.

The microwave permeable compartment is assembled by folding the microwave permeable components of blank 200 corresponding to the microwave shielded components described above in exactly the same manner as the microwave shielded compartment is assembled. Therefore, a description of the assembly of the microwave permeable compartment is not included herein.

Accordingly, the above-described configurations provide a simple and efficient method of manufacturing a multi-compartment heating container 10 which allows one compartment to be heated by microwave energy while another compartment is substantially shielded from the microwave energy. This configuration allows multiple products to be placed into the heating container 10 and exposing the heating container 10 to microwave energy, while only the products in the non-shielded portion of the heating container 10 are actually heated by the microwave energy.

What is claimed is:

1. A paperboard container for heating products placed therein by microwave energy, said container comprising:

a first region substantially shielded from microwave energy;

a second region permeable by microwave energy;

said first and second regions each including a top panel and a bottom surface; a single bottom panel forming the bottom surface for both of said first and second compartments; and a plurality of side panels extending upwardly from said bottom panel and extending downwardly from said top panels;

wherein said first and second regions are formed from a unitary, single sheet of microwave permeable paperboard material; said first region having a layer of microwave shielding material affixed to at least a portion of said single sheet of microwave permeable paperboard material forming said first region.

2. The paperboard container as defined in claim 1, wherein said paperboard container is generally of a clamshell shape with said top panels closing over said bottom panel.

3. The paperboard container as defined in claim 2, wherein said microwave shielding material is aluminum foil.

4. The paperboard container as defined in claim 1, wherein said microwave shielding layer covers at least a portion of said top panel, at least a portion of said bottom panel, at least a portion of said side panels and at least a portion of at least two of said end panels.

5. The paperboard container as defined in claim 4, wherein said paperboard container is generally of a clamshell shape with said top panel closing over said bottom panel.

6. The paperboard container as defined in claim 4, wherein said microwave shielding material is aluminum foil.

7. The paperboard container as defined in claim 4, wherein said microwave shielding layer is formed over approximately half of said single sheet of microwave permeable paperboard material; said microwave shielding layer covering approximately half of said top panel, approximately half of said bottom panel, approximately half of said side panels and entirely covering at least two of said end panels.

8. A paperboard container for heating a product placed therein by microwave energy while shielding another product placed therein from the microwave energy, said container comprising:

a top panel;

a bottom panel;

a plurality of side panels extending upwardly from said bottom panel; a plurality of side panels extending downwardly from said top panel;

a shielding panel laminated with a microwave shielding material; and a plurality of side walls connected to said shielding panel by fold lines formed between a respective one of said side walls and a respective edge of said shielding panel; said plurality of side walls also laminated with a microwave shielding material;

said top panel, bottom panel, shielding panel and their respective side panels being formed from a unitary, single sheet of microwave permeable paperboard material;

wherein one of said side walls connected to said shielding panel is hingedly attached to one of said side walls connected to said top panel; said shielding panel being foldable to lie adjacent to and substantially parallel to said top panel while the majority of said side walls connected to said shielding panel lie adjacent to and substantially parallel to a respective side wall connected to said top panel.

9. The paperboard container as defined in claim 8, wherein said paperboard container is generally of a clamshell shape with said top panels closing over said bottom panel.

10. The paperboard container as defined in claim 8, wherein said microwave shielding material is aluminum foil.

11. A paperboard container for heating a product placed therein by microwave energy while shielding another product placed therein from the microwave energy, said container comprising:

a bottom panel;

a first top panel;

a second top panel situated adjacent to said first top panel; said first and second top panels being situated in substantially the same plane;

a plurality of side panels extending upwardly from said bottom panel; a plurality of side panels extending downwardly from both said first and said second top panels;

a first end wall connected to said bottom panel by a fold line; said first end wall also connected to said first top panel through a fold line;

a second end wall connected to said bottom panel by a fold line; said second end wall also connected to said second top panel through a fold line;

a first dividing wall connected to said first top panel by a fold line; and a second dividing wall connected to said second top panel by a fold line;

said first and second top panels, said plurality of side panels, said bottom panel, said first and second end walls, and said first and second dividing walls being formed from a unitary, single sheet of microwave permeable paperboard material;

said first end wall, first top panel, said plurality of side panels extending downwardly from said top panel, and first dividing wall having a layer of microwave shielding material formed thereon;

said first end wall, said first top panel, said plurality of side panels extending downwardly from said top first panel and said first dividing wall enclosing a microwave shielded compartment over a portion of said bottom panel;

said second end wall, said second top panel, said plurality of side panels extending downwardly from said second top panel and said second dividing wall enclosing a microwave heatable compartment over a remaining portion of said bottom panel.

12. The paperboard container as defined in claim 11, wherein said paperboard container is generally of a clamshell shape with said top panels closing over said bottom panel.

13. The paperboard container as defined in claim 11, wherein said microwave shielding material is aluminum foil.

14. A method for forming a microwave heating container having a having at least one compartment substantially shielded from microwaves, comprising the steps of:

forming a unitary, single sheet of microwave permeable material;

laminating a portion of said single sheet of microwave permeable material with a strip of microwave shielding material;

cutting said sheet of microwave permeable material and laminated portion into a single, formable blank;

forming fold lines in said blank; and folding said blank along said fold lines to form a substantially closed container;

wherein an area within said closed container is substantially enclosed by said portion of said blank laminated with said microwave shielding material; said closed container further including another area which is not substantially enclosed by said microwave shielding material.

15. A carton blank formed of a microwave permeable material for forming a multi-compartment microwave heating carton, said blank comprising:

a first panel having side walls connected thereto by fold lines formed between a respective one of said side walls and a respective edge of said first panel;

a second panel having side walls connected thereto by fold lines formed between a respective one of said side walls and a respective edge of said second panel; one of said side walls of said second panel being hingedly attached to one of said side walls of said first panel through a scored fold line; said hingedly attached side walls positioned between said first and second panels;

opposing end panels connected to at least two of said side walls of said first and second panels by a fold line formed between said end panels and an edge of said walls; and a predetermined region of said first panel having a layer of microwave shielding material formed thereon.

16. The blank as defined in claim 15, wherein said layer of microwave shielding material is formed over approximately half of said first and second panels and approximately half of said hingedly attached side walls; said layer of microwave shielding material being formed completely over at least one side wall connected to said first panel and at least one side wall connected to said second panel.

17. The blank as defined in claim 16, wherein said layer of microwave shielding material formed over said first and second panels and said side walls is a single, unitary sheet of microwave shielding material.

18. The blank as defined in claim 15, further including a third panel;

said third panel having side walls connected thereto by fold lines formed between a respective one of said side walls and a respective edge of said third panel;

one of said side walls of said third panel being hingedly attached to one of said side walls of said first panel through a fold line;

said third panel and said side walls connected thereto comprising the predetermined region of said first panel having a layer of microwave shielding material formed thereon.

19. A carton blank formed of a microwave permeable material for forming a multi-compartment microwave heating carton, said blank comprising:

a first panel having side walls connected thereto by fold lines formed between a respective one of said side walls and a respective edge of said first panel;

a second panel having side walls connected thereto by fold lines formed between a respective one of said side walls and a respective edge of said second panel; one of said side walls of said second panel and one of said side walls of said first panel being congruent;

a third panel having side walls connected thereto by fold lines formed between a respective one of said side walls and a respective edge of said third panel; one of said side walls of said third panel and one of said side walls of said first panel being congruent; and opposing end panels connected to at least two of said side walls connected to said second and third panels by fold lines formed between a respective one of said end panels and a respective edge of one of said side walls;

wherein said second panel, said side walls connected to said second panel and their respective end panels include a layer of microwave shielding material formed thereon.

20. The blank as defined in claim 19, wherein said layer of microwave shielding material is a single sheet of microwave shielding material laminated to said second panel, said side walls connected to said second panel and their respective end panels.

* * * * *